US008439348B2

(12) United States Patent
Suzuki et al.

(10) Patent No.: US 8,439,348 B2
(45) Date of Patent: May 14, 2013

(54) SHEET FEEDING APPARATUS AND IMAGE FORMING APPARATUS

(75) Inventors: Tomoo Suzuki, Hachioji (JP); Akira Kosugi, Hachioji (JP); Daisuke Ueda, Hachioji (JP)

(73) Assignee: Konica Minolta Business Technologies, Inc. (JP)

( * ) Notice: Subject to any disclaimer, the term of this patent is extended or adjusted under 35 U.S.C. 154(b) by 0 days.

(21) Appl. No.: 13/248,442

(22) Filed: Sep. 29, 2011

(65) Prior Publication Data

US 2012/0074639 A1 Mar. 29, 2012

Related U.S. Application Data

(63) Continuation-in-part of application No. 12/762,838, filed on Apr. 19, 2010, now abandoned.

(30) Foreign Application Priority Data

Apr. 20, 2009 (JP) ..... 2009-101733
Apr. 9, 2010 (JP) ..... 2010-90148

(51) Int. Cl.
*B65H 3/12* (2006.01)

(52) U.S. Cl.
USPC ..... 271/96; 271/98

(58) Field of Classification Search ..... 271/96–98, 271/11, 12, 90, 91
See application file for complete search history.

(56) References Cited

U.S. PATENT DOCUMENTS 4,357,007 A * 11/1982 Mens Franciscus et al. ... 271/96
7,537,208 B2 * 5/2009 Fukusaka et al. ..... 271/96
7,731,175 B2 6/2010 Kang
7,845,629 B2 * 12/2010 Mitsuya et al. ..... 271/11

(Continued)

FOREIGN PATENT DOCUMENTS

JP 2000-203733 A 7/2000
JP 2003-182873 A 7/2003
JP 3855512 B2 9/2006
JP 3891405 B2 12/2006

OTHER PUBLICATIONS

Office Action for U.S. Appl. No. 12/762,838 dated Jul. 21, 2011.
PTO Form 892 for U.S. Appl. No. 12/762,838 dated Jul. 21, 2011.

(Continued)

*Primary Examiner* — Prasad Gokhale
(74) *Attorney, Agent, or Firm* — Cantor Colburn LLP

(57) ABSTRACT

A sheet feeding apparatus which includes: a sheet loading tray for stacking sheets; a suction and conveyance section placed above stacked sheets on the sheet loading tray and sucks and conveys a sheet in the sheet conveying direction; an air blowing section which blows air at the stacked sheets on the sheet loading tray and causes the sheet to float up; a skew correction section which is provided with a pair of conveyance rollers, and corrects a skew of the sheet being conveyed by the suction and conveyance section; and a control section which controls a force of sucking the sheet, wherein the control section changes the force of sucking the sheet from a first level to a second level that is lower than the first level, before a leading edge of the sheet butts against a pair of conveyance rollers of the skew correction section.

7 Claims, 12 Drawing Sheets

U.S. PATENT DOCUMENTS

| | | | | |
|---|---|---|---|---|
| 2007/0045932 | A1 | 3/2007 | Koga et al. | |
| 2007/0080491 | A1 | 4/2007 | Suga et al. | |
| 2007/0228639 | A1* | 10/2007 | Matsumoto et al. | 271/97 |
| 2007/0235921 | A1* | 10/2007 | Schalk et al. | 271/242 |
| 2008/0237968 | A1* | 10/2008 | Suzuki | 271/98 |
| 2009/0250865 | A1* | 10/2009 | Matsumoto | 271/11 |
| 2010/0025918 | A1* | 2/2010 | Miyazawa | 271/12 |

OTHER PUBLICATIONS

Restriction Requirement for U.S. Appl. No. 12/762,838 dated Apr. 8, 2011.

* cited by examiner

SHEET FEEDING APPARATUS AND IMAGE FORMING APPARATUS

CROSS REFERENCE TO RELATED APPLICATION

The present application is a continuation-in-part application of U.S. patent application Ser. No. 12/762,838 filed Apr. 19, 2010, which claims the priority of Japanese Application JP 2009-101733 filed Apr. 20, 2009 and Japanese Application JP 2010-90148 filed Apr. 9, 2010.

BACKGROUND OF THE INVENTION

1. Technical Field

The present invention relates to a sheet feeding apparatus that separates and feeds one sheet at a time from a stack of sheets placed on a table for sheets, and to image forming apparatuses.

2. Background Technology

In recent years, air sheet feeding apparatuses that can feed a large quantity of sheets are being used in image forming apparatuses such as copying machines, printers, etc. An air sheet feeding apparatus is one in which a sheet is made to float up by blowing air on to the side surface of a stack of sheets, a sheet is made to get sucked on to the suction surface of a belt, etc., in which are formed air suction holes that suck in air, and the sheet is conveyed by driving the belt in a rotating manner.

Conventionally, this kind of sheet feeding apparatus was one that fed large quantifies of sheets of the same size or of the same type. However, in recent years, due to the progress in digital information technology, a printing method called print on demand has come into widespread use in which the data prepared by a computer, etc., is printed out directly without going through an intermediate step of preparing offset printing films or plates, and sheet feeding apparatuses have become necessary that can feed sheets of various types and sizes that are being used in the printing industry.

In Examined Japanese Patent Application Publication No. 3855512 (Patent Document 1), an air sheet feeding apparatus has been disclosed wherein, nozzles (sheet raising means) that jet out air on the front surface of a stack of sheets for causing a sheet to float up, and nozzles (sheet separating means) for blowing air for separating other sheets from a single sheet that is made to be sucked and attached to the conveying belt are provided on the front side of the stack of sheets in the direction of feeding the sheet.

According to Patent Document 1, sheet feeding is made possible without feeding several sheets simultaneously by selectively switching the air from the sheet raising means and the sheet separating means according to the timing of sheet feeding by the conveying belt.

In Examined Japanese Patent Application Publication No. 3891405 (Patent Document 2), an air sheet feeding apparatus has been disclosed wherein, a sheet at the topmost surface of a stack of sheets is fed while being sucked by a suction and conveyance means because the sheet is floated up by a first air blowing means that blows air on the front surface of a stack of sheets from the front side of the direction of sheet feeding, and a second air blowing means that blows air on the side surface of the stack of sheets.

According to Patent Document 2, a positioning member is provided that restricts the height on the side surface of a sheet or in its neighborhood, a constant sheet separation is obtained at all times by selecting the air blow from a second air blowing means in accordance with the size of the sheet.

However, in an air sheet feeding apparatus described in Patent Document 1 or Patent Document 2, in order to separate definitely the topmost sheet that is sucked by the sucking and conveying section from the other sheets, a certain amount of space is required in the up-down direction between the topmost surface of the stack of sheets and the suction and conveyance section.

In this kind of configuration, in the floating process of transiting from the stacked state to the state of getting sucked by the sucking and conveying section, since the raised sheet can take various types of postures (such as flexure or distortion) depending on the condition of the air getting into the stack of sheets, conditions can arise in which the leading edge of the sheet is sucked by the suction and conveyance section at an angle to the conveying direction. If a sheet is sucked and conveyed in this condition, the suction area moves towards the trailing edge so as to maintain the position of the leading edge of the sheet that is inclined. In other words, the sheet gets skewed.

As described above, an air sheet feeding apparatus has the problem that the fluctuations in the sheet skewing are large, and improvement of sheet skewing is desired. In particular, the demand is very strict about the positional accuracy of the image farmed on a sheet and the sheet (image registration) in the field of print on demand, and improvement of sheet skewing is strongly desired in the case of air sheet feeding apparatuses used in this field.

In an image forming apparatus, although a skewing correction mechanism (paper registration mechanism) is provided at a position just before image transfer, particularly in the case of sheets of large sizes, since the part of the sheet on the upstream side is nipped by a plurality of conveying rollers, even if an attempt is made to correct a large skewing at this point of time, due to the pulling of the sheet between the registration mechanism and the conveying rollers, a large stress is applied on the sheet, problems occur such as buckling or wrinkling, etc.

An object of the present invention is to solve the problem that the fluctuations in sheet skewing are large, and to provide an air sheet feeding apparatus having excellent sheet feeding performance that is demanded in the print on demand field.

SUMMARY OF THE INVENTION

A sheet feeding apparatus and a system reflecting the aspects of the present invention for solving the above problems are described in the following items.

1. A sheet feeding apparatus including: a sheet loading tray for stacking sheets; a suction and conveyance section which is placed above stacked sheets on the sheet loading tray and sucks and conveys a sheet in the sheet conveying direction; an air blowing section which blows air at the stacked sheets on the sheet loading tray and causes the sheet to float up; a skew correction section which is provided with a pair of conveyance rollers, and corrects a skew of the sheet being conveyed by the suction and conveyance section; and a control section which controls a force of sucking the sheet by the suction and conveyance section, wherein the control section changes the force of sucking the sheet by the suction and conveyance section from a first level to a second level that is lower than the first level, before a leading edge of the sheet butts against a pair of conveyance rollers of the skew correction section.

2. The sheet feeding apparatus of item 1, wherein the pair of conveying rollers is provided on a downstream side in the sheet conveying direction relative to the suction and conveyance section to convey the sheet conveyed from the suction and conveyance section towards the downstream side in the sheet conveying direction, and to correct the skew of the sheet being conveyed by the suction and conveyance section; and wherein the control section controls the pair of conveyance rollers to stop, and during the period when the pair of conveyance rollers is stopped, controls at least the pair of conveyance rollers so that a leading edge of the sheet is made to abut against the pair of conveyance rollers.

3. The sheet feeding apparatus of item 1, wherein the suction and conveyance section comprises a plurality of sheet conveyance sections, each of the plurality of sheet conveyance sections being arranged along a width direction perpendicular to the sheet conveyance direction.

4. The sheet feeding apparatus of item 1, wherein the pair of conveyance rollers comprises a plurality of conveyance roller sections, each of the plurality of conveyance roller sections being arranged along a width direction perpendicular to the sheet conveyance direction.

5. The sheet feeding apparatus of item 1, further comprising a sheet detection sensor which detects a leading edge of the sheet being conveyed by the suction and conveyance section, wherein the control section controls a drive of the pair of conveyance rollers and the force of sucking the sheet by the suction and conveyance section, based on detection information of the leading edge of the sheet detected by the sheet detection sensor.

6. An image forming system including: the sheet feeding apparatus of item 1; and an image forming apparatus which forms an image on a sheet conveyed by the sheet feeding apparatus.

7. The image forming system of item 6 further comprising a second skew correction section which is provided at a position immediately before the image is transferred onto the sheet conveyed from the sheet feeding apparatus, and makes the sheet abut against registration rollers that conveys the sheet in synchronization with the image being formed, and corrects the skew of the sheet again.

8. The image forming system of item 6, wherein the suction and conveyance section comprises a plurality of sheet conveying sections, each of the plurality of sheet conveying sections being arranged along a width direction perpendicular to the sheet conveyance direction.

9. The image forming system of item 6, wherein the pair of conveyance rollers comprises a plurality of conveyance roller sections, each of the plurality of conveyance roller sections being arranged along a width direction perpendicular to the sheet conveyance direction.

10. The image forming system of item 6, wherein the sheet feeding apparatus further comprises a sheet detection sensor which detects a leading edge of the sheet fed out by the suction and conveyance section, wherein the control section controls a drive of the pair of conveyance rollers and the force of sucking the sheet by the suction and conveyance section, based on detection information of the leading edge of the sheet detected by the sheet detection sensor.

BRIEF DESCRIPTION OF THE DRAWINGS

These and other objects, advantages and features of the invention will become apparent from the following description thereof taken in conjunction with the accompanying drawings in which.

DETAILED DESCRIPTION OF THE PREFERRED EMBODIMENT

While some preferred embodiments of the present invention are described below with reference to the drawings, the present invention shall not be construed to be limited to the preferred embodiments described below.

Some preferred embodiments of the present invention are described below with reference to the drawings.

Figure 1:
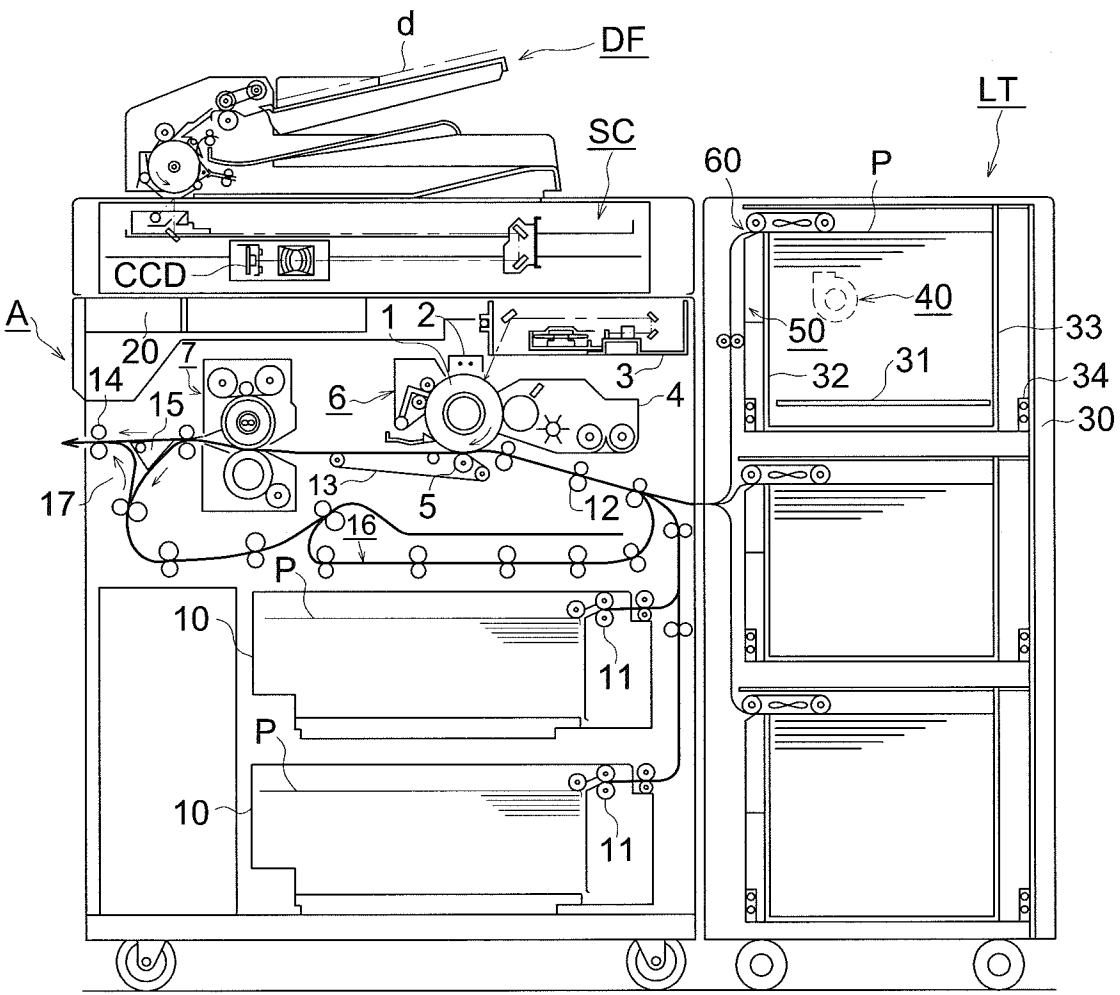
FIG. 1 is an overall configuration diagram of an image forming apparatus having an image forming apparatus, an image reading apparatus, an automatic document feeding apparatus, and a large quantity sheet feeding apparatus.

Image Forming Apparatus:

FIG. 1 is an overall configuration diagram of an image forming apparatus having an image forming apparatus A, an image reading apparatus SC, an automatic document feeding apparatus DF, and a large quantity sheet feeding apparatus LT.

The image forming apparatus A shown in the figure is configured from an image forming section having a photoreceptor (image carrier) 1, a charging unit 2, an image exposure unit 3, a developing unit 4, a transfer unit 5, and a cleaning unit 6, etc., a fixing unit 7, and a sheet conveying system.

The sheet conveying system is configured to have a sheet feeding cassette 10, a first sheet feeding section 11, a second sheet feeding section 12, a sheet discharging section 14, a conveying path switching section 15, a reentrant sheet refeeding section 16, and an inverting sheet discharging section 17.

A document d placed on the document table of the automatic document feeding apparatus DF is conveyed by a sheet feeding section, the images on one side or both sides of the document are read out by the optical system of the image reading apparatus SC, and read by an image sensor CCD. After the analog signal obtained by photoelectric conversion by the image sensor CCD is subjected to, in the image processing section 20, analog processing, A/D conversion, shading correction, image compression processing, etc., the image signal is sent to the image exposure unit 3.

In the image forming section, the processes of charging, exposure, developing, transfer, separation, cleaning, etc., are carried out.

In the image forming section, electric charge (negative electric charge in the present preferred embodiment) is put by the charging unit 2 on the photoreceptor 1, an electrostatic latent image is formed by laser light emission from the image exposure unit 3, and the electrostatic latent image is converted into an apparent image by the developing unit 4 and becomes a toner image (the toner image has negative electric charge in the present preferred embodiment). Next, a sheet P stored in the sheet feeding cassette 10 is conveyed from a first sheet feeding section 1. On the other hand, the toner remaining on the photoreceptor 1 after transferring is cleaned by the cleaning unit 6.

The sheet P is conveyed in synchronization with the toner image by the second sheet feeding section 12 made of a registration roller. At this time, the skew during conveying is corrected by the sheet P abutting against the second sheet feeding section. In other words, the second sheet feeding section 12 is not only a registration section that synchronizes the toner image and the sheet P, but also a skew correction section that corrects the skew of the sheet during conveying. After that, the sheet P has the toner image transferred onto it by the transfer section after which it is fixed by the fixing unit 7. The sheet P after fixing is discharged to outside the apparatus by the sheet discharging section 14.

Further, in the case of double sided copying, the sheet P with image formed on its first surface is fed to the reentrant sheet re-feeding section 16 and is turned upside down, and, after image formation is made on its second surface again in the image forming section, it is discharged to outside the apparatus by the sheet discharging section 14. In the case of inverting sheet discharge, after the sheet P that has been branched from the normal sheet discharge path is turned upside down by being switched back in the inverting sheet discharging section 17, it is discharged to outside the apparatus by the sheet discharging section 14.

Further, in the present preferred embodiment, the sheet feeding cassette 10 inside the image forming apparatus A can also have a sheet feeding apparatus according to the present invention to be described later, that is, it can have a suction and conveyance section, an air blowing section, and a skew correction section.

Sheet Feeding Apparatus:

The large quantity sheet feeding apparatus LT according to the present invention and connected to the image forming apparatus A has a sheet feeding apparatus main unit 30, a first air blowing section 40 and a second air blowing section 50 as air blowing sections, a suction and conveyance section 60, etc., stores a large quantity of sheets P, and feeds one sheet P at a time to the image forming apparatus A.

The sheet feeding apparatus main unit 30 has sheet loading trays 31, a sheet leading edge restricting member 32, a sheet trailing edge restricting member 33, and guide rails 34. There are three sheet loading trays 31, and the construction is such that each sheet loading tray 31 can be drawn out from the large quantity sheet feeding apparatus LT due to the guide rails 34. For example, in the large quantity sheet feeding apparatus LT, 1300 sheets can be loaded in the first tray, and 1850 sheets each can be stored in the second and third trays, so that in total it is possible to store about 6000 sheets.

Figure 2:
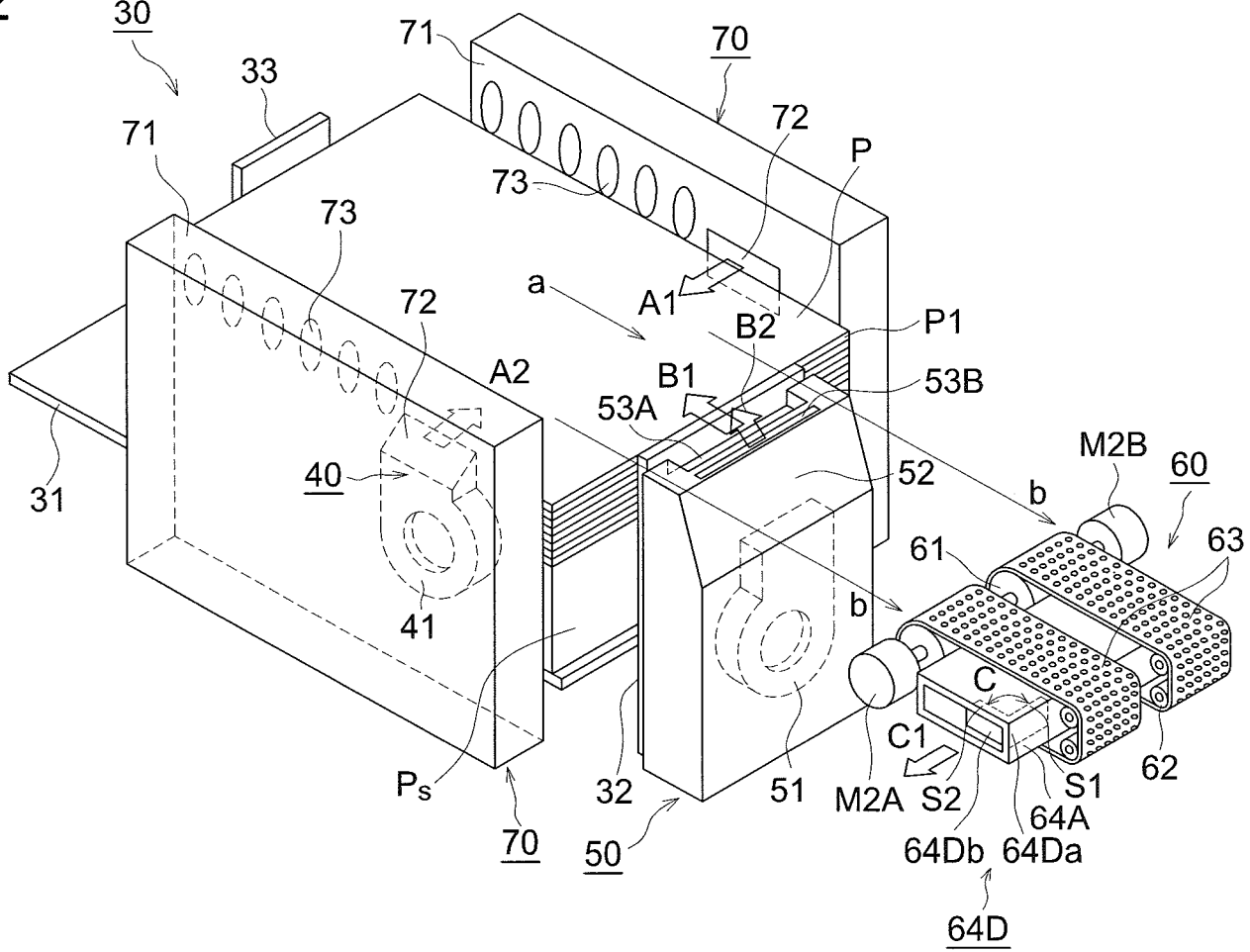
FIG. 2 is a perspective view of the important parts of a large quantity sheet feeding apparatus according to the present invention.
Figure 3:
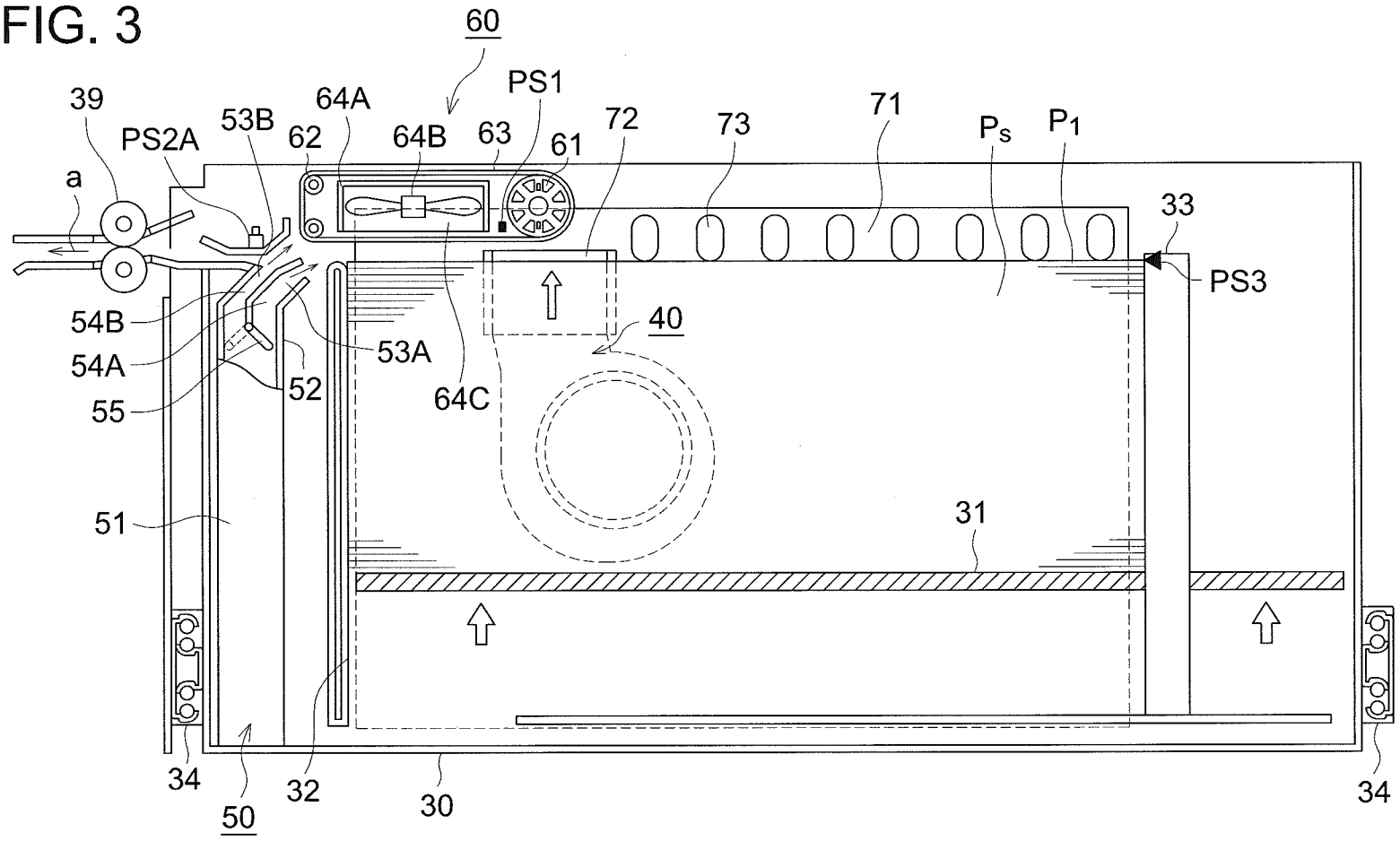
FIG. 3 is a front middle cross-sectional view diagram showing the main unit of a sheet feeding apparatus.
Figure 4:
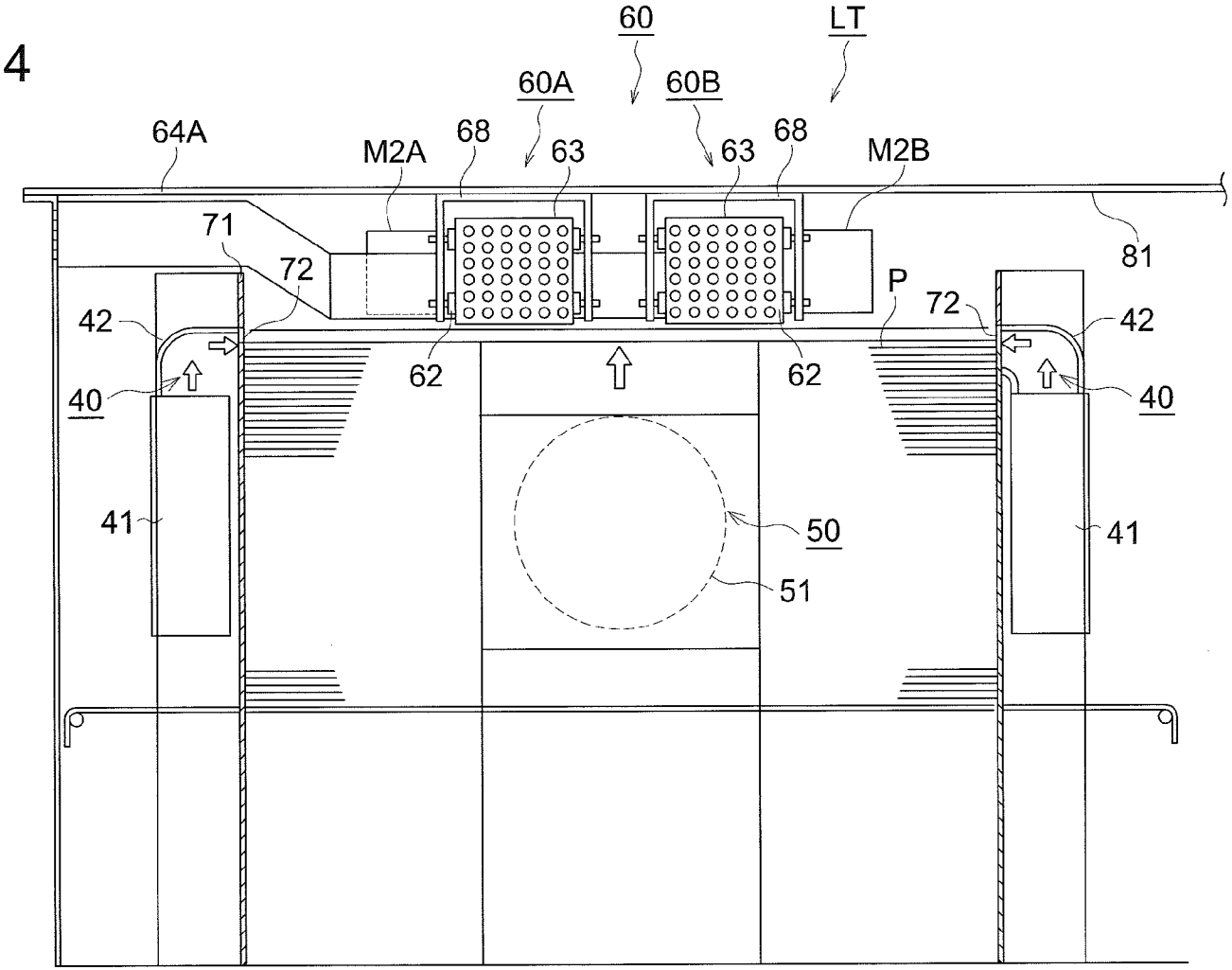
FIG. 4 is a side view diagram showing the main unit of a sheet feeding apparatus.
Figure 5:
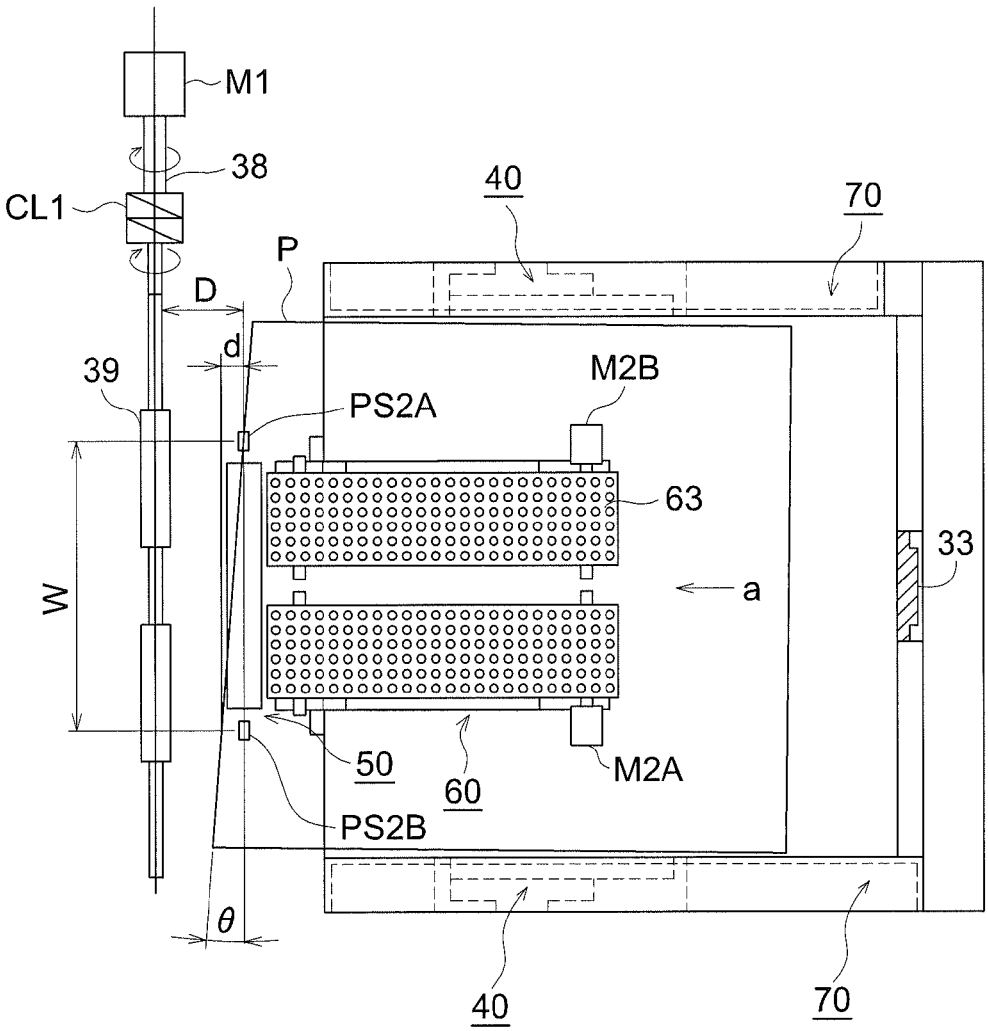
FIG. 5 is a plan view diagram showing the main unit of a sheet feeding apparatus.

FIG. 2 is a perspective view of the important parts of the sheet feeding apparatus main unit 30 according to the present invention, FIG. 3 is a front cross-sectional view diagram of the sheet feeding apparatus main unit 30, FIG. 4 is a side view diagram of the sheet feeding apparatus main unit 30, and FIG. 5 is a plan view diagram of the sheet feeding apparatus main unit 30.

The suction and conveyance section 60 of FIG. 2 has been shown in an assumed position that has been shifted horizontally towards the downstream side of the sheet conveying direction by the extent indicated by the arrow b from its actual position when installed in the sheet feeding apparatus main unit 30.

As is shown in FIG. 2, a sheet stack Ps and the topmost sheet P1 are placed on the sheet loading tray 31, and are stored so that they can be raised or lowered along with the sheet loading tray by a mechanism not shown in the figure.

A pair of sheet side edge restricting sections 70 restrict the sheet stack Ps in the width direction that is at right angles to the sheet conveying direction, and have on the inside the sheet side edge restricting members 71 in close contact with the side edges of the sheet stack Ps. The relative distance along the width direction of the sheets of the sheet side edge restricting section 70 can be changed freely, and restricts the position of the sheet stack Ps along the width direction according to the size of the sheet.

The sheet side edge restricting section 70 has a box type structure with a large strength of rigidity and is sufficiently long in the sheet feeding direction, and it has been made possible to maintain the gap between the sheet side edge restricting member 71 and the side edge of the sheet stack Ps even at the topmost part of the sheet stack Ps to within the prescribed values for a wide range of sheet sizes.

The sheet leading edge restricting member 32 restricts the leading edge of the sheet stack Ps in the sheet loading tray 31, and is fixed to the sheet feeding apparatus main unit 30.

The sheet trailing edge restricting member 33 can be moved freely along the length direction of the sheet P, restricts the position of the trailing edge of the sheet P in the sheet feeding direction, and is being supported by the sheet feeding apparatus main unit 30 so that it can be displaced along the sheet feeding direction. The sheet side edge restricting members 71 and the sheet trailing edge restricting member 33 are provided with a height and shape so that the sheet P can be restricted at all times even when the sheet P is made to float up by blowing air as described later.

Further, as is shown in FIG. 3, in the sheet trailing edge restricting member 33 is placed a height sensor PS3 that detects the height of the topmost part of the sheet stack loaded in the sheet loading tray.

The topmost position of the of the sheet stack Ps loaded in the sheet loading tray 31 is maintained by a control section to be described later, based on the signal of the height sensor PS3, so as to be at the most optimum height for receiving the air blow. In other words, based on the result of detection by the height sensor PS3 shown in FIG. 3, the bottom plate 34 of the sheet loading tray 31 is raised by driving a raising and lowering motor not shown in the figure, and control is carried out so that the topmost part of the stack of sheets Ps is at all times maintained to be at the prescribed height.

Mechanism of Sheet Separation Using Air Blow:

As is shown in FIG. 2, air is being blown from the sheet conveying direction and from the sheet width directions on the topmost part of the sheet stack Ps. The air blow in the sheet width direction is along the two directions of the arrows A2 and A2, and even in the sheet conveying direction, the air blow is as indicated by the arrows B1 and B2.

First Air Blowing Sections:

As is shown in FIG. 2 and FIG. 3, the first air blowing sections 40 that blow air on to the top of the sheet stack Ps from the width directions are placed on both sides of the sheet loading tray 31. The first air blowing sections 40 are provided in the sheet side edge restricting section 70. A first air blowing section 40 is made of an air blowing fan 41, guide plates 42, etc. The air blow indicated by the arrows A1 and A2 is blowing air above the top part of the sheet stack Ps from the first air blow outlet 72 placed in the sheet side edge restricting member 71 of the sheet side edge restricting section 70. As is shown in FIG. 4, the air blowing fan 41 has been installed on the sheet side edge restricting section 70 with its air outlet facing upward. The air that is discharged upwards has its direction changed by 90° by the guide plate 42 and is blown horizontally from the first air blow outlet 72 of the sheet side edge restricting member 71.

Further, the first air blow outlet 72 and the first air blow section 40 are provided in the sheet side edge restricting section 70, can be moved integrally with the sheet side edge restricting member 71, and it has been made possible to have a constant positional relationship with the sheet stack Ps at all times while corresponding to changes in the sheet size.

As is shown in FIG. 3, relative to the first air blow outlet 72, there are several air exhaust outlets 73 provided on the side surface of the sheet side edge restricting member 71 positioned on the upstream side in the direction of sheet conveying, and it has been ensured that there is no large distortion in the shape of the sheet that has floated up.

Second Air Blowing Section:

Next, the second air blowing section 50 placed on the downstream side of the sheet loading tray 31 in the sheet conveying direction and acting as a sheet separation section and as a sheet floating up section is described based on FIG. 2 and FIG. 3.

The second air blowing section 50 is constituted from an electric fan 51 and an air flow guide 52 connected to the electric fan 51. The second air blowing section 50 blows air towards the leading edge and topmost part of the sheet stack loaded in the sheet loading tray from the second air blow outlet 53A of the air flow guide 52. The electric fan 51 has been installed inside the air flow guide 52. In the top part of the air flow guide 52, there is a second air blow outlet 53A facing towards the downstream side of the sheet conveying direction. The air ejected from the second air blow outlet 53A is facing horizontally towards the downstream side of the sheet conveying direction as shown by the arrow B1 in FIG. 2.

The air blow from the second air blow outlet 53A is the air blow for making the sheet P at the topmost part of the sheet stack Ps separate and float up, and is being blown at the top part of the leading edge of the sheet stack Ps. At this time, the second air blowing section 50 operates as a floating up section that makes the sheet float up.

Further, in the top part of the air flow guide 52, there is a third air blow outlet 53B on the downstream side of the second air blow outlet 53A, and the third air blow outlet 53B has been cut open so as to face upwards. The air flow from the third air blow outlet 53B, as is shown in the arrow B2 in FIG. 2, is pointing towards an obliquely upward direction at a sheet that is conveyed towards the upstream side relative to the detection position of the two sheet detection sensors PS2A (PS2B) which are explained in detail later.

The air blown in the direction B2 from the third air blow outlet 53B is the air blow for making only one sheet get sucked and conveyed by the suction and conveyance section 60, and is being blown in the direction of the suction belt 63 of the suction and conveyance section 60.

The air flow guide 52, as is shown in FIG. 3, links the second air blow outlet 53A and the electric fan 51, or is formed to have a duct structure that links the third air blow outlet 53B and the electric fan 51. The duct is branched into a first duct 54A and a second duct 54B. Further, there is a shutter 55 at the branching point, and this shutter 55 makes it possible to switch the air flow rate through the first duct 54A and the second duct 54B.

The second air blowing section 50, according to the selection by the shutter 55, functions as a sheet flowing up section that ejects air from the second air blow outlet 53A which is at the end of the first duct 54A, or as the sheet separation section that ejects air from the third air blow outlet 53B which is a the end of the second duct 54B.

By making the shutter 55 operate as an air flow switching section as shown in FIG. 3 by a solenoid not shown in the figure, the function as a sheet separation section is put in the operating state or the stopped state, or else, the function as a sheet floating up section is put in the stopped state or the operating state. In other words, the second air blowing section 50 has two switchable functions. It is both the sheet floating up section that makes a sheet P float up and the sheet separation section that separates the sheet P. As is shown in FIG. 3, when the shutter is in the state indicated by continuous lines, the sheet separation section is in the operating state, and when it is in the state indicated by broken lines, the sheet separation section is in the stopped state.

Suction and Conveyance Section:

As is shown in FIG. 3, the suction and conveyance section 60 is positioned above the sheet stack Ps loaded in the sheet loading tray and is placed on the downstream side of the sheet conveying direction, and is fixed to the top supporting member 81 of the large quantity sheet feeding apparatus LT.

As is shown in FIG. 2 and FIG. 4, the suction and conveyance section 60 has the first sheet conveying section 60A and the second sheet conveying section 60B along the width direction at right angles to the sheet conveying direction. Each sheet conveying section has a supporting member 68, a large diameter roller 61, two small diameter rollers 62, and a suction belt 63 that is wound around and rotates over the large diameter roller 61 and the small diameter rollers 62.

Each supporting member 68 is fixed to the top supporting member 81, and respectively supports one large diameter roller 61 and two small diameter rollers 62 in a free to rotate manner.

The axes of the two large diameter rollers 61 are respectively coupled to two suction and conveyance motors (having a first suction and conveyance motor M2A and a second suction and conveyance motor M2B) which are fixed to each of the supporting members 68. Further, two suction belts 63 can be rotated independently of each other by the two suction and conveyance motors.

The suction belts 63 have a plurality of penetrating holes of small diameter pierced in them as is shown in the figure. On the inside of each suction belt 63 is a suction duct 64A of the suction section 64 and are fixed to the supporting member 68.

The suction section 64 is made of a suction duct 64A and a suction fan 64B coupled thereto. At the bottom of the suction duct, there are openings 64C (FIG. 3) opposing respectively the suction belt 63. The openings 64C determine the air suction position of the suction and conveyance section 60. The sucked air is exhausted to the back of the large quantity sheet feeding apparatus LT via the suction duct 64A.

Further, it is also possible to have a configuration in which a suction fan 64B is provided in a fixed manner at the deep end of the sheet feeding apparatus main unit 30, and connect it to the suction and conveyance section 60 by a suction duct.

The suction fan 64B is operating all the time, and the suction and conveyance section 60 adheres by sucking to the suction belt 63 the topmost sheet P that has floated up due to air blowing by the sheet separation mechanism which is described later. Next, due to the operation of the first suction and conveyance motor M2A and the second suction and conveyance motor M2B, the suction belt 63 rotates whereby the sheet P is conveyed in the sheet conveying direction (arrow a), and fed to the image forming apparatus A. It is possible to carry out control of varying independently the speeds of the first suction and conveyance motor M2A and the second suction and conveyance motor M2B, and these two operate under operating conditions that have been adjusted in advance so that the sheet P is conveyed in the sheet conveying direction.

At a rear side of the suction duct 64A, a suction force adjusting valve 64D (shown by dotted line) which enables to switch a sucking force Fp for sucking the sheet to be sucked on the suction belt 63 into a plurality of levels. The suction force adjusting valve 64D is configured with an adjusting blade 64Db and an axis 64Da provided in the suction duct MA to support the adjusting blade 64Db rotatably in an arrow direction C, wherein the adjusting blade 64Db is displaced to a first position S1 or a second position S2 (shown in FIG. 2) by an unillustrated drive mechanism which is connected to the axis 64Da and structured with a second solenoid and a spring. The sucking force Fp for sucking the sheet becomes a first level Fp1 when the adjusting blade 64Db is positioned at the first position S1, and when changed to the second position S2, the sucking force Fp is switched to the second level Fp2 which is lower than the first level Fp1.

As described above, the suction and conveyance section 60 is capable of switching the force Fp for sucking the sheet between the first level Fp1 to the second level Fp2 which is lower than the first level. In this embodiment, two levels of sucking force are adopted, but not being restricted to this, multiple levels may be adopted.

As is shown in FIG. 3, in the neighborhood of the opening 64C of the suction duct 64A, a sheet suction and adhesion sensor PSI has been placed that detects whether or not the topmost sheet P has been sucked by and adhered to the suction belt.

Further, on the outlet side of the large quantity sheet feeding apparatus LT is placed a conveying roller pair 39 made of a master and a slave conveying rollers that definitely convey the sheet P conveyed by the suction belt to the image forming apparatus A.

Sheet Detection Sensor:

In addition, between the suction and conveyance section 60 and the conveying roller pair 39 in the sheet conveying direction, and also in the neighborhood of the suction belt 63, a first sheet detection sensor PS2A and a second sheet detection sensor PS2B that detect the leading edge of the sheet P that is passing through are placed along the width direction.

FIG. 5 is a plan view diagram of the sheet feeding apparatus main unit, and shows that a first sheet detection sensor PS2A and a second sheet detecting section PS2B are placed on the downstream side in the sheet conveying direction (the direction of the arrow a) from the suction and conveyance section 60 while being separated by W (mm) along the width direction. In addition, a conveying roller pair 39 has been placed on the downstream side at a separation of D (mm) from the detection positions of the two sheet detection sensors. A clutch CL1 is present between the shaft of the conveying roller pair 39 and the driving shaft 38 that rotates because of being coupled to conveying roller driving motor M1.

The clutch CL1 is a drive transmission selection section that switches the transmission of drive to the shaft of the conveying roller pair 39 from the driving shaft 38.

Figure 6:
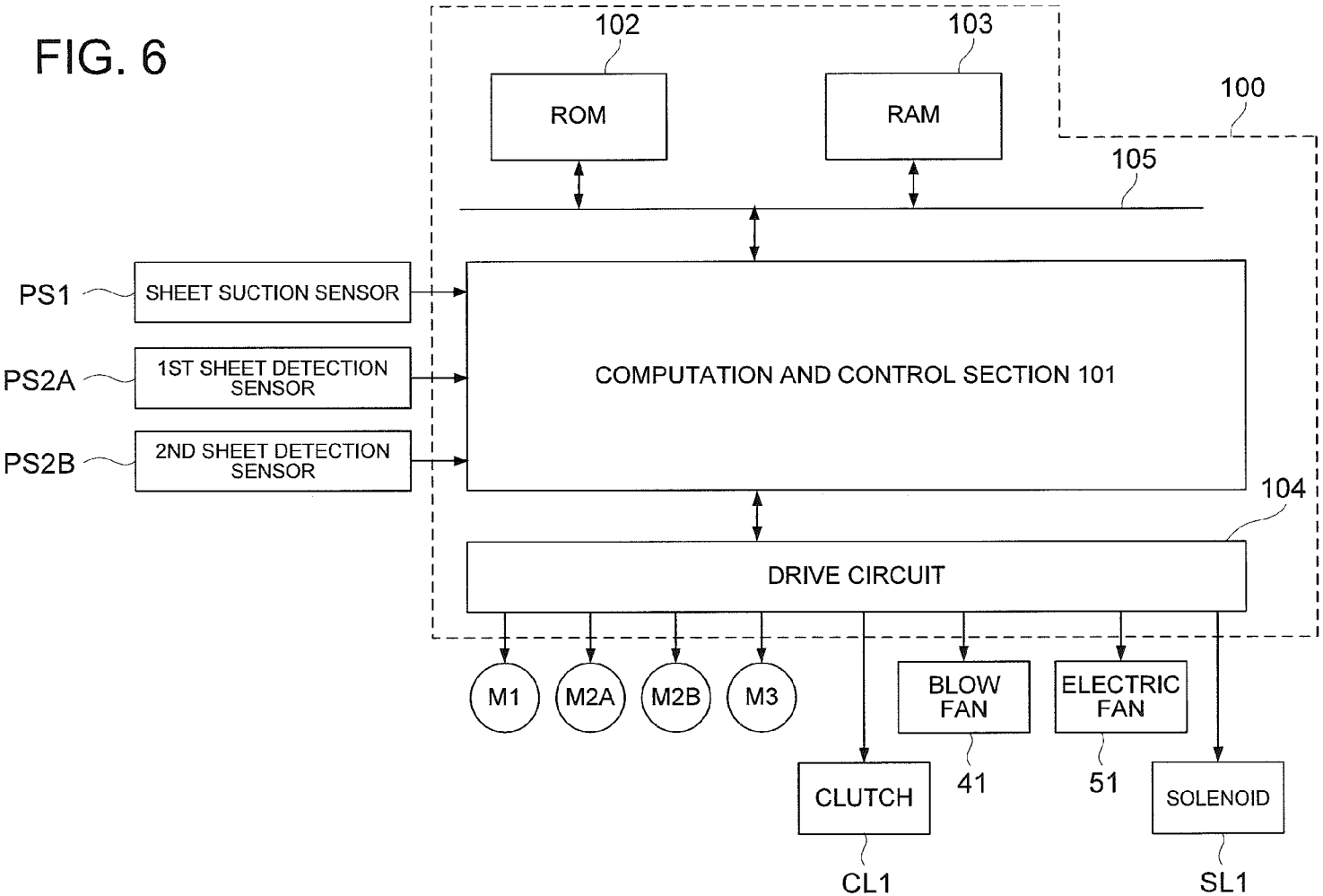
FIG. 6 is a block diagram showing the control system related to the control section 100 that also functions as a skew correction section that corrects the skew of a sheet according to the present invention.

Control Section:

FIG. 6 is a block diagram of the control system related to the control section 100 that also functions as a skew correction section that corrects the skew of sheets according to the present invention.

The control section 100 has a computation and control section 101 made of a CPU and that rules the sheet conveying control and the main part of the skew correction section, a ROM 102 that stores the programs, a RAM 103 that is used in the calculation control carried out by the computation and control section 101, drive circuits 104 that drive the motors and solenoids, etc., based on the instructions (signals) from the control section 100, and a bus 105.

The sheet suction sensor PS1, the first sheet detection sensor PS2A, and the second sheet detecting section PS2B are connected to the control section 100 via an input interface that is not shown in the figure.

The drive circuits 104 are the circuits that drive the solenoid SL1 that actuates the shutter 55 of FIG. 3, the clutch CL1 of FIG. 5, and the motors M1, M2A, and M2B shown in FIG. 2, FIG. 4, and FIG. 5, and the motor M3 to be described later.

The computation and control section 101, based on the signals from the first sheet detection sensor PS2A and the second sheet detecting section PS2B, and according to the control program, appropriately outputs to the drive circuits 104 the commands (signals) for driving the conveying roller driving motor M1, the first suction and conveyance motor M2A, and the second suction and conveyance motor M2B, so that sheets are conveyed one at a time to the image forming apparatus A.

Sheet Skew Detection Section:

The first sheet detection sensor PS2A and the second sheet detecting section PS2B detect the presence or absence of a passing sheet P, the timing th of the passing of the leading edge of a sheet is detected based on the timing at which the detection signal changes from the sheet absent level to the sheet present level. Also, the timing tr of the passing of the trailing edge of a sheet is detected based on the timing at which the detection signal changes from the sheet present level to the sheet absent level. Further, the sheet present or absent signal, the sheet leading edge detection signal, and the sheet trailing edge detection signal are output to the computation and control section 101.

The computation and control section 101 detects the time tha of the leading edge detection signal of the first sheet detection sensor PS2A and the time thb of the leading edge detection signal of the second sheet detection sensor PS2B, and based on their time difference (tha−thb), computes the amount (angle) and direction of skew of the sheet P.

If the linear speed of the suction and conveyance belt 63 that is driven rotationally by the first suction and conveyance motor M2A and the second suction and conveyance motor M2B is taken as Vb (mm/sec), and the skew angle of the sheet P is taken as S, then the relationship of Equation 1 will be satisfied.

$$\theta = \arctan\{Vb(tha-thb)/W\} \quad \text{Eqn. 1}$$

As is shown in FIG. 5, θ is the skew angle of the leading edge of the sheet P, W is the distance between the detection position of the first sheet detection sensor PS2A and the detection position of the second sheet detection sensor PS2B.

The computation and control section 101 is calculating the sheet skew angle θ(°) based on Eqn. 1. In addition, the direction of the skew is being judged depending on whether the difference (tha−thb) is negative or positive. When this difference is negative, the sheet P is judged to be skewed to the right, and to the left if the difference is positive.

Further, the amount of skew of the sheet P can also be the time difference (tha−thb) of leading edge detection, or it can also be the distanced indicated in FIG. 5.

The present invention shall not be limited to the sheet detection sensors shown here, but can also be on that detects the trailing edge of the sheet P.

The sheet skew detection section can also be one that detects the above time difference (tha−thb) itself as the amount of skew. Further, it is also possible to store in advance a correspondence table between the time difference (tha−thb) and the skew angle θ, and to detect the skew angle θ by referring to this table.

Skew Correction Section of the First Preferred Embodiment:

FIG. 5 is an outline diagram showing the conveying roller pair used in the skew correction section of the first preferred embodiment of the present invention.

The skew correction section of the first preferred embodiment is one that controls at least the rotational drive of the conveying roller pair 39, by temporarily stopping the rotating conveying roller pair 39, so that the leading edge of the sheet P abuts against the conveying roller pair 39 during the period that the conveying roller pair 39 has stopped. The operation of the clutch CL1 is controlled so that the rotation of the conveying roller pair 39 is started again when a prescribed time period has elapsed after the leading edge of a sheet P is detected from the signal of a sheet detection sensor (PS2A or PS2B). Therefore, correcting sheet skew has been made possible using a paper registration mechanism of carrying out control so that the conveying roller pair 39 that was conventionally being rotated continuously is made to stop temporarily at a prescribed timing, and again made to start rotating again at another prescribed timing. The role undertaken by the loop forming roller in a conventional paper registration mechanism is being played by the suction belt 63.

Figure 7A:
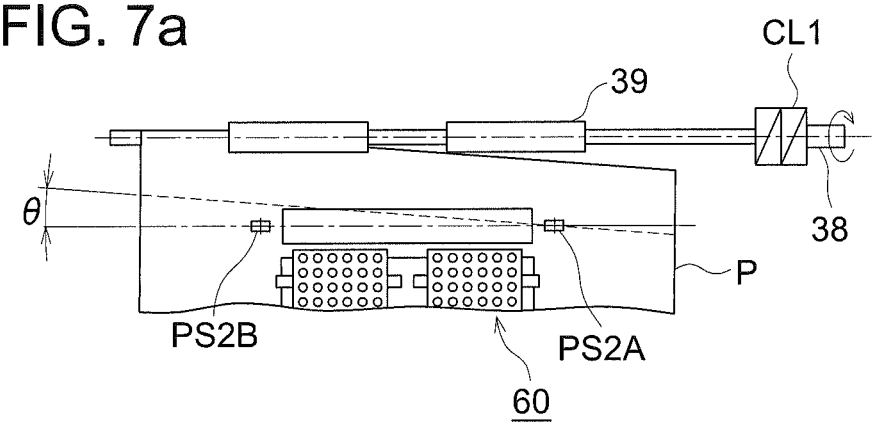
FIGS. 7*a*-7*c* are schematic diagrams showing the operation of the conveying roller pair and the process of sheet correction.
Figure 7B:
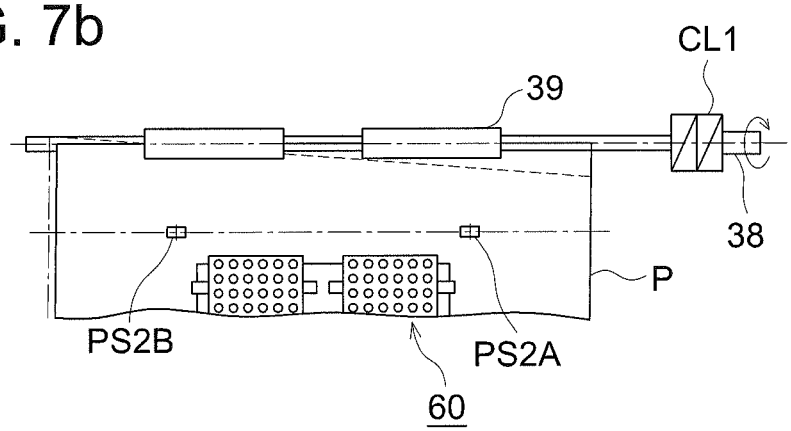
Figure 7C:
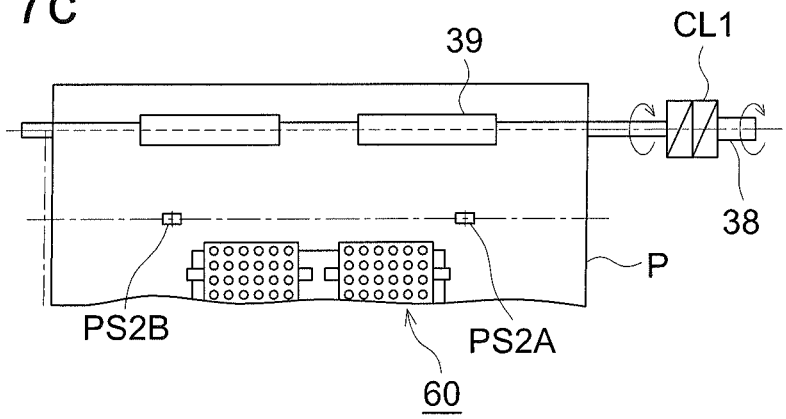

FIGS. 7*a*-7*c* are schematic diagrams showing the operation of the conveying roller pair and the process of sheet correction.

FIG. 7*a* shows a sheet P at the point of time when a sheet P skewed to the right has arrived at the nip of the left side conveying roller pair 39. The broken line indicates the leading edge of the sheet P at the point of time when the leading edge of sheet P is passing through the first sheet detection sensor PS2A. At this point of time, the clutch CL1 has stopped transmitting drive power; and the conveying roller pair 39 has stopped. It is very important that the clutch CL1 should have stopped before the leading edge of the sheet P has arrived at the nip.

Further, when the first sheet detection sensor PS2A detects the leading edge of the sheet P, the suction and conveyance section 60 changes a force Fp of sucking the sheet from a first level Fp1 to a second level Fp2 by the activation of the second solenoid. Specifically, the suction and conveyance section 60 changes the force Fp of sucking the sheet from a first level Fp1 to a second level Fp2, before the leading edge of the sheet P butts against the pair of conveyance rollers 39. In the state shown in FIG. 7*a*, the force Fp of sucking the sheet has been changed to the second level Fp2 that is lower than the first level Fp1.

Namely, compared to the conventional configuration combined with a pair of conveyance rollers and a loop forming roller, the configuration combined with the pair of conveyance rollers 39 and the suction and conveyance section 60 is capable of keeping a weak constraint force against the sheet P at the downstream side of the pair of conveyance rollers 39, and capable of properly adjusting the constraint force. Therefore, according to the configuration relating to the present invention, even in cases where a large skew of the sheet is generated at the upstream side, the skew of sheet P can be smoothly corrected without causing a crease or a fold of sheet.

The angle θ shown in the figure is the angle of skew of the sheet P.

FIG. 7*b* shows the condition in which the leading edge of a sheet P has penetrated into the entire area of the nip of the conveying roller pair 39 by the conveying force of the suction and conveyance section 60. The skew of the leading edge of the sheet P has been eliminated. The single dot and dash line at the left of the sheet P indicates the area in which the curling of the sheet P has become large. Corresponding to the sheet skew angle θ shown in FIG. 4, the looping of the left part of the leading edge of the sheet P is larger than the right part of the leading edge. At this point, the state of the clutch CL1 is continuing to be the off state of power transmission. Of course, an appropriate amount of looping is formed even at the right part of the leading edge of the sheet (the area D in FIG. 5).

Here, the force Fp of sucking the sheet of the suction and conveyance section 60 has been changed from a first level Fp1 to a second level Fp2, and the looping of the left part of the leading edge of the sheet P is kept within a range that does not cause a crease or fold in sheet corner and the like.

FIG. 7*c* is the point of time after the state of FIG. 7*b* has been passed, the state of the clutch CL1 has switched to the ON state of power transmission, and a certain additional time period has elapsed. As is shown in the figure, the skew of the sheet P has been corrected from the leading edge side due to the conveying force of the conveying roller pair 39 and sheet P is being conveyed normally in the sheet conveying direction.

The loop formed in the sheet P in FIG. 7*b*, gradually moves toward the rear part of the sheet while maintaining its size, and gets eliminated when sheet P progresses and its trailing edge side is near the position where it is released from the suction and conveyance section 60.

The leading edge of the sheet P, which is floated up by the flow of air and is conveyed while being sucked by the suction belt 63 of the suction and conveyance section 60 with a skew angle of θ, has its progress stopped at the nip of the conveying roller pair 39 in the stopped condition. On the other hand, since the sheet next to the sheet P is conveyed at a prescribed interval by the suction and conveyance section 60 in the leading edge prevented condition, a loop with a prescribed range is formed in the sheet in the region D shown in FIG. 5.

However, formation of a loop is only in the case of sheets which are easily buckled such as thin sheets, etc., and in the case of sheets which are not easily buckled such as thick sheets, etc., when the leading edge of the sheet arrives at the nip of the conveying roller 39 that is in the stopped state, because slipping occurs between the suction belt 63 and the sheet, the leading edge of the sheet abuts uniformly.

After a prescribed period has elapsed, the state of the clutch CL1 is switched to the ON state of power transmission, the conveying roller pair 39 starts rotating, and the sheet P is discharged towards the image forming apparatus A after its skew is corrected.

As has been shown above, the sheet P, has no problems of sheet folding or wrinkling, and is conveyed to the downstream side with its skew corrected from the leading edge part.

Figure 8:
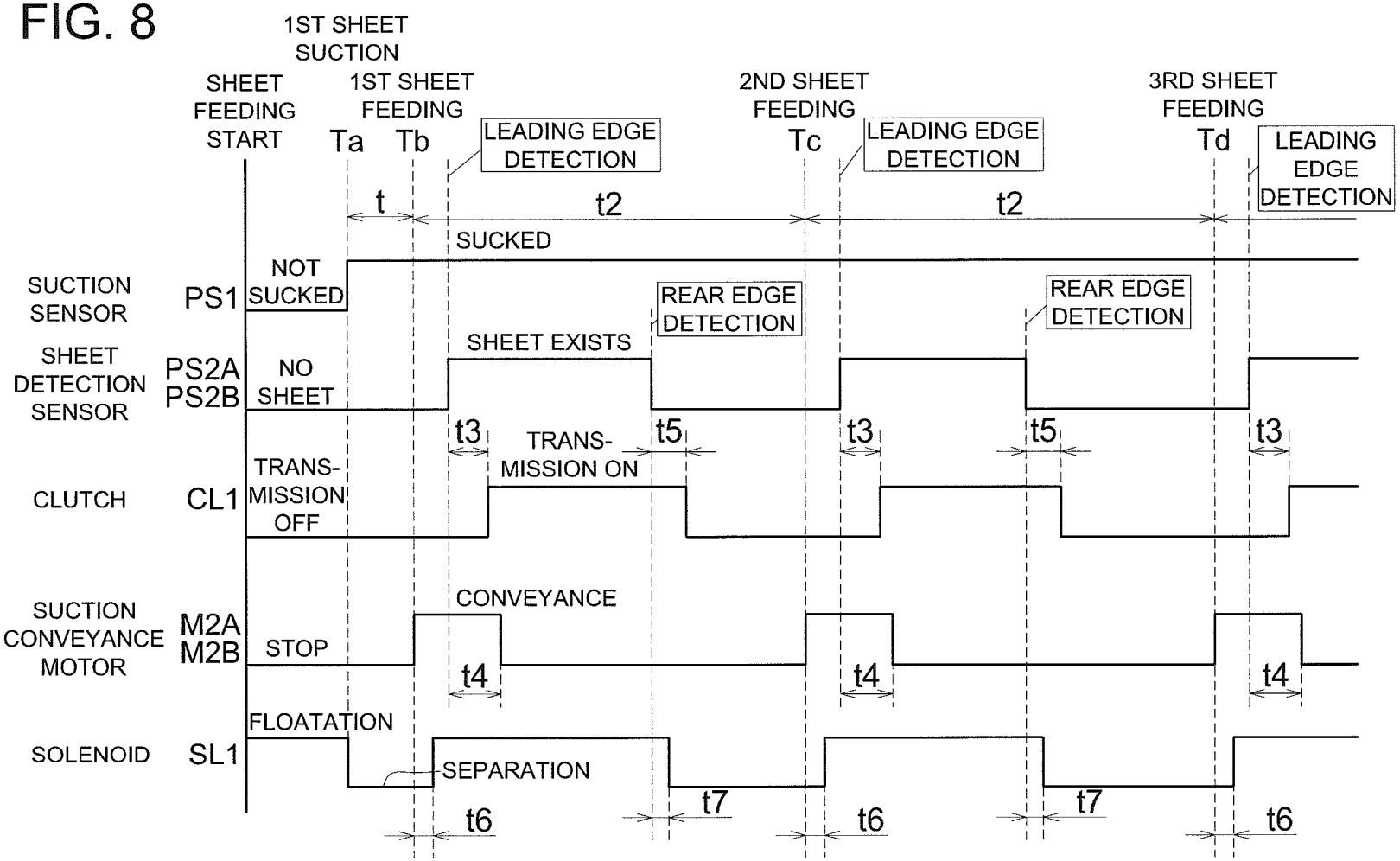
FIG. 8 is an operation timing chart showing the sheet conveying control related to a first preferred embodiment.

FIG. 8 is a timing chart of the operations of the sheet conveying control related to the first preferred embodiment.

FIG. 8 shows the operation timings related to the sheet suction section PS1 and the first sheet detection sensor PS2A (the second sheet detection sensor PS2B), the clutch CL1 that carries out drive power transmission to the conveying roller pair 39, the first suction and conveyance motor M2A and the second suction and conveyance motor M2B that rotate the suction belt 63, and the solenoid SL1 that actuates the shutter of the second air blowing section.

The operation timings of the conveying roller drive motor M1 and the air blowing fan 41 of the first air blowing section that floats up the sheet P, and of the motor fan 51 of the second air blowing section are the period from the start of sheet feeding until end of sheet feeding, during which period these are operating, which has been omitted from the descriptions.

FIG. 8 shows the timing chart for the period from the beginning of sheet feeding in continuous sheet feeding to near the starting feeding the third sheet. The timing of sheet conveying is broadly divided into the first sheet suction Ta and first sheet feeding Tb, second sheet feeding Tc, and third sheet feeding Td, The operation timings of the different sections are determined by t3 to t7 set in advance for the sheet feeding starting timings Tb, Tc, and Td of the different sheets, the sheet leading edge detection timings, and for the sheet trailing edge detection timings.

The timings of the sheet leading edge detection and the sheet trailing edge detection are judged based on the detection signals of the sheet detection sensors PS2A and PS2B, and differ for each sheet feeding.

The operation of the clutch CL1 that switches the drive of the conveying roller pair 39 that is carried out by the skew correction section of the first preferred embodiment according to the present invention is described below according to FIG. 8.

The computation and control section 101 puts the clutch CL1 in the power transmission OFF state when a sheet feeding is started. Next, a timer is started when the leading edge of a first sheet P is detected from the detection signal of the sheet detection sensor, and the clutch CL1 is switched to the power transmission ON state after a prescribed time duration t3 has elapsed.

The prescribed time period t3 is selected within a range so that it satisfies the following Eqn. 2, and also so that sheet folding, wrinkling, etc., due to excessive looping of the sheet P does not occur. D in Eqn. 2 is the distance (in mm) shown in FIG. 4, and Vb is the conveying speed of the sheet P by the suction belt 63. Further, tm is the looping time determined for forming loops of less than a prescribed range.

$$t3=D/Vb+tm \qquad \text{Eqn. 2}$$

The control section 100 starts a timer when the trailing edge of the first sheet P is detected from the detection signal of the sheet detection sensor, and the clutch CL1 is switched to the power transmission OFF state after a prescribed time duration t5 has elapsed, and stops the conveying roller pair 39 in advance in order to correct the skew of the second sheet.

Further, when receiving a detection signal of the first sheet detection sensor PS2A. the suction and conveyance section 60 changes a force Fp of sucking the sheet from a first level Fp1 to a second level Fp2. As the result, the skew correction of the sheet P and formation of proper looping of the sheet can be smoothly performed without causing a crease or a fold of sheet. After the drive of clutch CL1, sucking force Fp of the sheet is switched from the second level to the first level to increase the force Fp, this allows a sure absorption of the next sheet.

The control section 100 carries out controls such as the above, even for the second and succeeding sheets, and the skew of the sheet that occurs at the time that a sheet is sucked by the suction and conveyance section is corrected.

However, although the looping time has been set here as tm, it is also possible to use a loop detection section that detects the amount of loop of the sheet.

Figure 9:
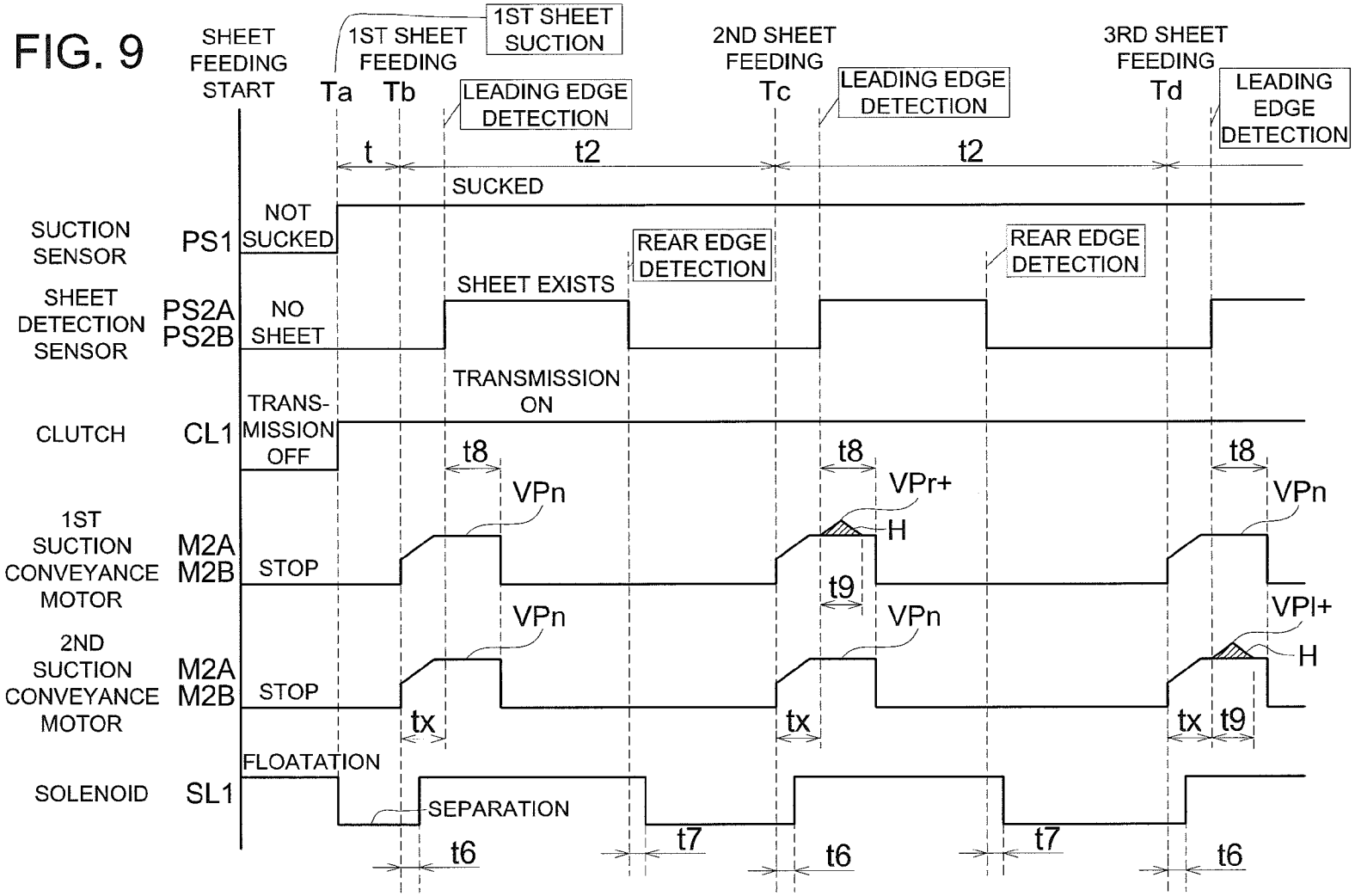
FIG. 9 is a time chart showing the sheet conveying control carried out by the control section 100 as a skew correction section according to a second preferred embodiment of the present invention.

Skew Correction Section of a Second Preferred Embodiment:

FIG. 9 is a time chart showing the operations of the different parts of the sheet feeding apparatus main unit 30 related to the sheet conveying control carried out by the control section 100 as a skew correction section according to the second preferred embodiment of the present invention.

The computation and control section 101 according to the second preferred embodiment of the present invention calculates the difference (tha−thb) between the sheet left and right leading edge timings based on the signals of the first sheet detection sensor PS2A and the second sheet detection sensor PS2B, and in addition, calculates the skew angle θ of the sheet and the skew direction data SD according to the above Eqn. 1. Next, the speed profile corresponding to the skew angle θ is determined by referring to a table that is not shown in the figure but that is stored in the ROM 102, and outputs the determined speed profile to the drive circuit 104 of FIG. 6. The drive circuit 104 drives the first suction and conveyance motor M2A and the second suction and conveyance motor M2B in accordance with the received profile.

These two suction and conveyance motors are both stepping motors, and drive the large diameter roller 61 in a rotating manner by a prescribed angle per each unit pulse signal. In addition, the sheet P can be conveyed at mutually independent conveying speeds, and the orientation of the sheet conveyed by the suction and conveyance section 60 can be changed freely by the speed profiles of the first suction and conveyance motor M2A and the second suction and conveyance motor M2B.

In the time chart of FIG. 9, the speed profiles of the two suction and conveyance motors are shown as VPn, VPr+, and VPl+.

VPn is the reference speed profile. VPr+ is the speed profile for correcting right skew with respect to the reference speed profile. VPl+ is the speed profile for correcting left skew with respect to the reference speed profile.

FIG. 9 is only an example, and the amount of skew of the first sheet P is within the prescribed range, and is the case in which sheet skew correction is judged to be not required. The computation and control section 101 determines the speed profiles of both the suction and conveyance motors to be the reference speed profile VPn.

On the other hand, the amount of sheet skew of the second sheet P is more than the prescribed range, and also the skew is towards the right, and this is the case in which sheet skew correction is judged to be required. The computation and control section 101 determines the speed profile of the first suction and conveyance motor M2A as the speed profile VPr+ according to the detected amount of skew in this case and determines the speed profile of the second suction and conveyance motor M2B as the reference speed profile VPn.

Further, the amount of sheet skew of the third sheet P is more than the prescribed range, and also the skew is towards the left, and this is the case in which sheet skew correction is judged to be required. The computation and control section 101 determines the speed profile of the second suction and conveyance motor M2B as the speed profile VPl+ according to the detected amount of skew in this case and determines the speed profile of the first suction and conveyance motor M2A as the reference speed profile VPn.

Further, the integrated area (speed×time) of the speed profile corresponds to the distance that the leading edge of the sheet P has progressed beyond leading edge detection. In the example shown in the second sheet in FIG. 9, the integrated area of the VPr+ speed profile is larger by the area of the projection shape H in the figure relative to the integrated area of the speed profile VPn. Therefore, the right part of the sheet progresses well in the sheet conveying direction by the distance corresponding to this area, and the sheet P rotates to the left relatively. As a result, the right part of the sheet progresses corresponding to the amount of skew d towards the right shown in FIG. 4 and the skew of the sheet is completely corrected.

Further, as a condition of making the correction of the sheet P complete, it is necessary to complete the correction of the skew of the sheet before the leading edge of the sheet arrives at the nip of the conveying roller pair 39.

As is shown in the timing chart of FIG. 9, the projection shape H has been set to within the time period t9 (t9=t8−α) shown in the figure considering the fluctuations in the conveying speed, etc., of the suction belt 63. Here, t8 is the time period from the detection of the leading edge until the leading edge of the sheet arrives at the nip of the conveying roller pair 39, and a is a constant considering the above fluctuations.

Further, the computation and control section 101 determines the above speed profile VPr+ or VPl+ by referring to the table not shown in the figure so that the area of the projection shape H shown in FIG. 9 changes according to the amount of skew or the skew angle, and outputs the speed profile VPn and the determined VPr+ or VPl+ to the drive circuit 104.

The drive circuit 104 drives the first suction and conveyance motor M2A or the second suction and conveyance motor M2B in accordance with the speed profile VPn or VPr+ or VPl+ input by the computation and control section 101.

In the above manner, in the skew correction section of the second preferred embodiment, the amount of skew of the sheet P is detected, after the orientation of the sheet P sucked by the suction and conveyance section 60 is changed with respect to the suction and conveyance section 60 according to the detected amount of skew thereby correcting the skew of the entire sheet including the leading edge, the sheet is sheet is conveyed to the nip of the conveying roller 39 with the same speeds at left and right at all times during the period from t9 to t8 shown in FIG. 9, this is a method that does not require the formation of a loop as in the first preferred embodiment, this method is superior in stable conveying of the sheet, and can convey smoothly. However, since this is a method in which high performance is required in the time resolution of the sheet skew detection section as the conveying speed of the apparatus becomes faster, it is necessary to take care such as selecting the sensors considering sufficiently the conveying speed at the time of design, etc.

Skew Correction Section of a Third Preferred Embodiment:

The skew correction section of a third preferred embodiment of the present invention is a control section 100 that controls the angle varying section as a displacement section described below so that the angle of the suction and conveyance section 60 with respect to the sheet conveying direction is changed according to the skew angle of the leading edge of the sheet P.

Figure 10:
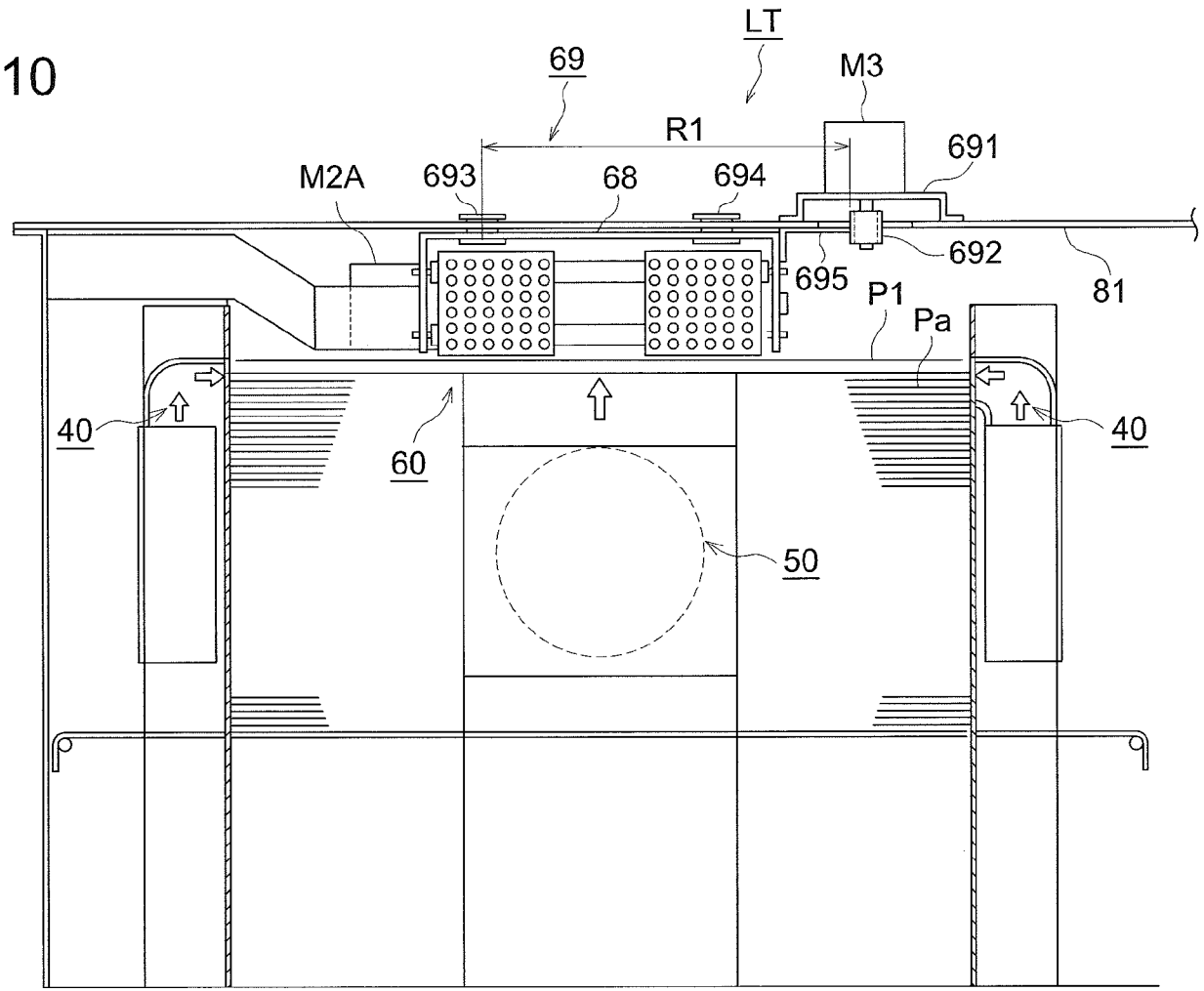
FIG. 10 is schematic diagram showing an angle varying section 69 that varies the angle of the suction and conveyance section 60.

FIG. 10 shows an angle varying section 69 that varies the angle of the suction and conveyance section 60. As is shown in the figure, the two conveying belts 63 are rotated together by driving the first suction and conveyance motor M2A.

The supporting member 68 of the suction and conveyance section 60 is supported below the top supporting member 81 of the sheet feeding apparatus main unit 30 by one reference supporting shaft 693 and tow sliding supporting shafts 694.

On the right end of the supporting member 68 is provided a flat gear wheel 695 drawing and ellipse with a radius R1 centering on the reference supporting shaft 693. On the other hand, above the top supporting member 81 of the sheet feeding main unit 30 is fixed a motor supporting member 691 that supports the angle varying motor M3, and a gear wheel 692 fixed to the shaft of the angle varying motor M3 engages with the flat gear wheel 693.

Figure 11:
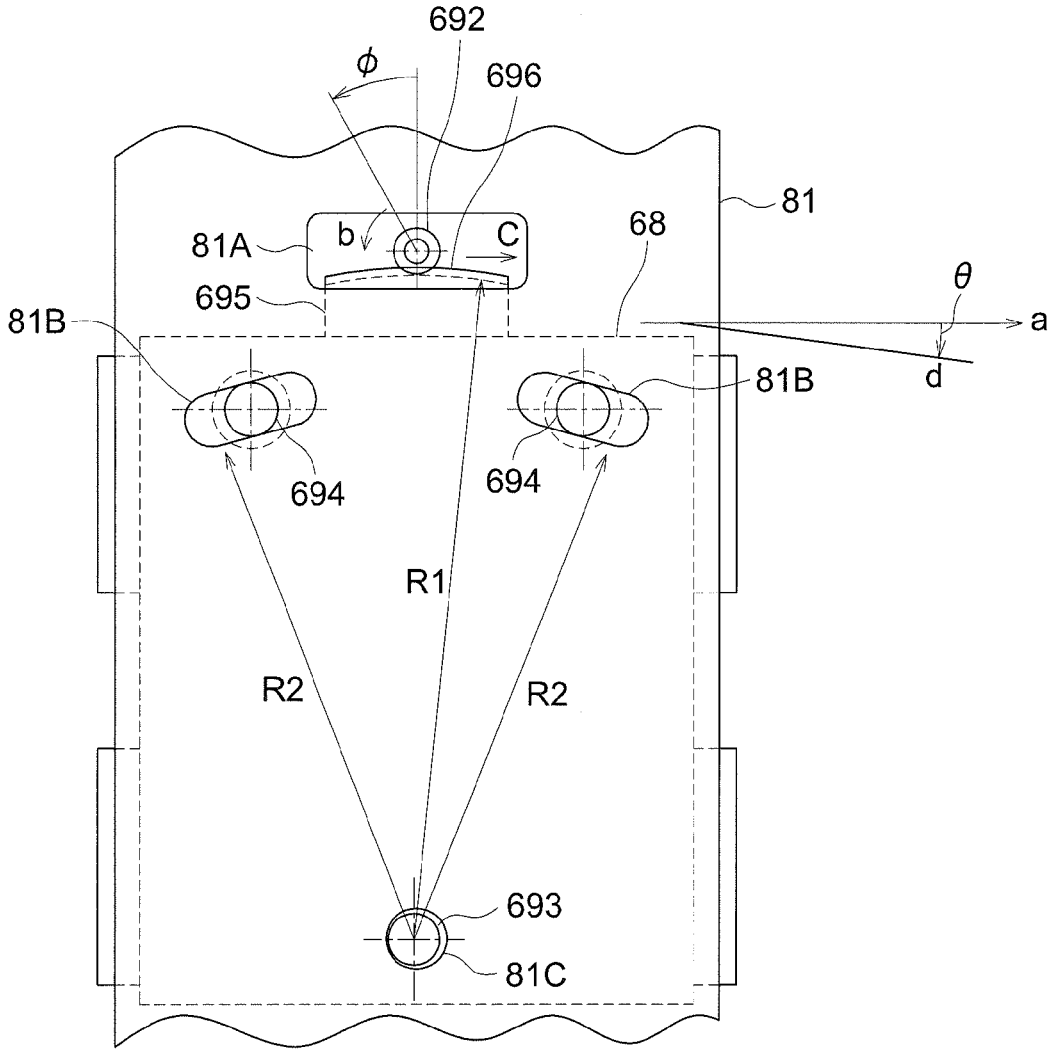
FIG. 11 is a schematic cross-sectional diagram in which the angle varying section 69 has been cut horizontally at the top surface of the top supporting member 81.

FIG. 11 is a cross-sectional view schematic diagram cutting the angle varying section 69 horizontally at the top surface of the tops supporting member 81, and shows the relationship between the top supporting member 81 and the supporting member 68 that is displaced with respect to the top supporting member 81.

The supporting member 68 that determines the orientation of the suction and conveyance section 60 can rotate horizontally with the reference hole 81C opened in the top supporting member 81 as the pivot. The top supporting member 81 has two holes 81B forming an inside ellipse R2, so that the sliding supporting shaft 694 can slide. In addition, a hole 81A is provided at the position of the radius R1 in which the gear wheel 692 fixed to the shaft of the angle varying motor M3 passes through.

The angle varying section 69 is one in which, when the gear wheel 692 of the angle varying motor M3 is rotated by an angle θ in the direction of the arrow b, the flat gear wheel 695 moves in the direction of the arrow c, the suction and conveyance section 60 moves in the direction of the arrow d, and rotates by an angle θ with respect to the sheet conveying direction.

The angle varying motor M3 is one that can accurately rotate the gear wheel 692 in the desired direction by the desired angle, and although a stepping motor is suitable and is used, it is not necessary to restrict to this.

Figure 12:
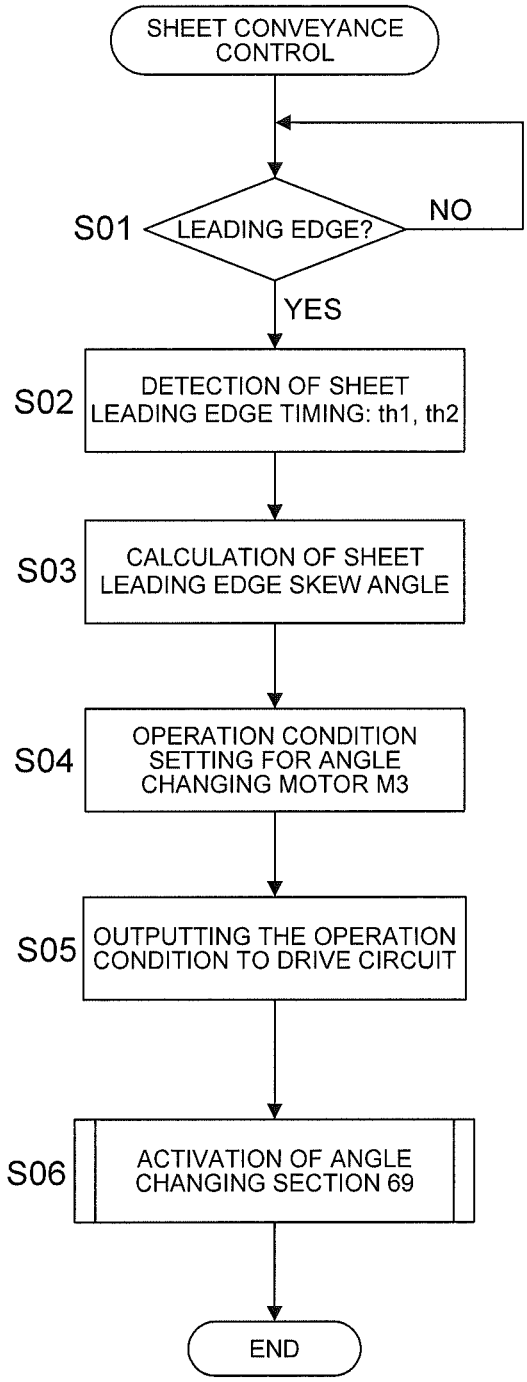
FIG. 12 is a flow chart showing the sheet conveying control carried out by the control section 100 functioning as a skew correction section according to a third preferred embodiment of the present invention.

FIG. 12 is a flow chart related to the sheet conveying control carried out by the control section 100 as a sheet skew correction section of the third preferred embodiment according to the present invention.

The Steps S01 to S05 are controlled by the computation and control section 101, and the Step S06 is controlled by the drive circuit 104.

The Step S01 is a step of judging whether or not the leading edge of the sheet P is detected by the first sheet detection section PS2A and the second sheet detection sensor PS2B. The operation progresses to Step S02 when the judgment is YES in this step.

The Step S02 is a step of detecting the timings th1 and th2 of the leading edge of the sheet P from the signals of the first sheet detection sensor PS2A and the second sheet detection sensor PS2B, and the operation proceeds to Step S03.

The Step S03 is a step of calculating the direction of skew of the sheet P based on the timings th1 and th2 of the leading edge of the sheet P and calculating the sheet skew angle θ based on Eqn. 1, The operation proceeds next to Step S04.

The Step S04 is a step of referring to the table corresponding to the direction of skew and the angle θ of the sheet skew obtained in Step S03 and obtaining the operating conditions of the angle varying motor (number of pulse steps and direction of rotation).

The Step S05 is a step of outputting the operation conditions obtained in Step S04 to the drive circuit 104.

The Step S06 is controlled by the drive circuit 104, and is a step in which the drive of the angle varying section 69 is controlled according to the operation conditions obtained from the computation and control section 101. For example, as is shown in FIG. 11, the motor shaft M3 is rotated in the counterclockwise direction by an angle ϕ, and the suction and conveyance section 60 rotates (in the direction of the arrow a) by an angle θ with respect to the sheet conveying direction. As a result, the sheet skew is corrected by an angle θ in the direction of left skew.

Further, the skew correction section 60 of the third preferred embodiment is, similar to the second preferred embodiment, one that carries out control so that the operation of the drive circuit 104 for correcting the skew of the sheet P is completed before the sheet P arrives at the nip of the conveying roller pair 39.

Further, in the skew correction sections of the second and third preferred embodiments, there are cases in which it is demanded that the timing of the leading edge of the sheet is detected accurately and that the amount of skew of the sheet P is detected with a high accuracy. In such situations, control is carried out so that air flow for separation by blowing air from the second air blowing section 50 shown in FIG. 3 is stopped before detecting the timing of the leading edge of the sheet, thereby increasing the sheet skew detection accuracy, and making it possible to prevent wrong detection of sheet skew. Explanation is given based on the timing chart of FIG. 10.

The time period t6 shows the time period from the timing of the start of feeding of each sheet P to the timing of switching the state of the solenoid SL1 from the separation state to the floating up state by operating the shutter of the second air blowing section. The time period tx is the time period from starting the sheet feeding until the time when the leading edge of the sheet is expected to be detected As is shown in the figure, t6 is set to be sufficiently smaller than tx so that the second air blowing section as a sheet separation section stops with sufficient margin before the timing at which the leading edge of the sheet P is detected. As a consequence, the second air blowing section as a sheet separation section is being controlled by the control section 100 as a skew correction section so that there is no problem caused to skew detection.

According to a sheet feeding apparatus of the present invention, by providing a skew correction section that corrects the skew of a sheet conveyed by the suction and conveyance section, it is possible to solve the problem of the skew of a sheet before it is sent to the conveying path on the downstream side from the air sheet feeding apparatus.

What is claimed is:

1. A sheet feeding apparatus comprising:

a sheet loading tray for stacking sheets; a suction and conveyance section which is placed above stacked sheets on the sheet loading tray and sucks and conveys a sheet in the sheet conveying direction;

an air blowing section which blows air at the stacked sheets on the sheet loading tray and causes the sheet to float up;

a first skew correction section which is arranged at a position immediately downstream of the suction and conveyance section in the sheet conveying direction, and is provided with a pair of conveyance rollers to convey the sheet conveyed from the suction and conveyance section towards the downstream side in the sheet conveying direction, and to correct a skew of the sheet while the sheet is conveyed by the suction and conveyance section;

a sheet detection sensor which detects a leading edge of the sheet being conveyed by the suction and conveyance section;

a control section which controls a force of sucking the sheet by the suction and conveyance section, a drive of the suction and conveyance section and a drive of the pair of conveyance rollers, wherein the control section controls the pair of conveyance rollers to stop, and during the period when the pair of conveyance rollers is stopped, controls the suction and conveyance section and the pair of conveyance rollers so that the leading of the sheet is made to abut the pair of conveyance rollers to form a loop of the sheet, thereby corrects the skew of the sheet, and wherein the control section is configured to be capable of setting the force of sucking the sheet by the suction and conveyance section, in a state of activating a suction fan to generate a suction force, at a first level for sucking the sheet with a prescribed force and a second level for sucking the sheet with lower force than the first level, and the control section changes the force of sucking the sheet by the suction and conveyance section from the first level to the second level while activating the suction fan, before the leading edge of the sheet butts against the pair of conveyance rollers of the first skew correction section when receiving detection information of the leading edge of the sheet detected by the sheet detection sensor.

2. The sheet feeding apparatus of claim 1, wherein the suction and conveyance section comprises a plurality of sheet conveyance sections, each of the plurality of sheet conveyance sections being arranged along a width direction perpendicular to the sheet conveyance direction.

3. The sheet feeding apparatus of claim 1, wherein the pair of conveyance rollers comprises a plurality of conveyance roller sections, each of the plurality of conveyance roller sections being arranged along a width direction perpendicular to the sheet conveyance direction.

4. An image forming system comprising:

the sheet feeding apparatus of claim 1; and an image forming apparatus which forms an image on a sheet conveyed by the sheet feeding apparatus.

5. The image forming system of claim 4 further comprising a second skew correction section which is provided downstream of the first skew correction section in the sheet conveying direction, and at a position immediately before the image is transferred onto the sheet conveyed from the sheet feeding apparatus, and makes the sheet abut against registration rollers that conveys the sheet in synchronization with the image being formed, and corrects the skew of the sheet again.

6. The image forming system of claim 4, wherein the suction and conveyance section comprises a plurality of sheet conveying sections, each of the plurality of sheet conveying sections being arranged along a width direction perpendicular to the sheet conveyance direction.

7. The image forming system of claim 4, wherein the pair of conveyance rollers comprises a plurality of conveyance roller sections, each of the plurality of conveyance roller sections being arranged along a width direction perpendicular to the sheet conveyance direction.

* * * * *